United States Patent [19]

Arbella

[11] Patent Number: 4,651,401

[45] Date of Patent: Mar. 24, 1987

[54] METHOD OF ERECTING LARGE CYLINDRICAL STORAGE TANKS WITH A PLURALITY OF VERTICAL PLATE BODIES ARRANGED INSIDE ONE ANOTHER

[75] Inventor: Rodolfo C. P. Arbella, Göteborg, Sweden

[73] Assignee: Handelsbolaget Rodoverken, Goteborg, Sweden

[21] Appl. No.: 704,224

[22] Filed: Feb. 22, 1985

[30] Foreign Application Priority Data

Feb. 23, 1984 [EP] European Pat. Off. ..... 84850059.1

[51] Int. Cl.[4] ..... B21D 39/03; B23P 11/00

[52] U.S. Cl. ..... 29/429; 220/3; 220/5 A; 220/469; 220/1 B; 228/176; 228/184; 52/741

[58] Field of Search ..... 29/429; 228/184, 176; 52/741, 745, 245; 220/3, 1 B, 3.1, 5 A, 469

[56] References Cited

U.S. PATENT DOCUMENTS

| | | | |
|---|---|---|---|
| 2,337,058 | 12/1943 | McKee | 228/184 X |
| 2,751,672 | 6/1956 | Reed | 29/429 |
| 2,866,261 | 12/1958 | Macku | 29/429 |
| 2,984,898 | 5/1961 | Svensson | 29/429 |
| 3,823,842 | 7/1974 | Chang | 220/5 A X |
| 4,067,097 | 1/1978 | Okamoto | 29/429 |
| 4,078,295 | 3/1978 | Koller | 29/429 |

*Primary Examiner*—Charlie T. Moon

*Attorney, Agent, or Firm*—Pollock, Vande Sande & Priddy

[57] ABSTRACT

The present invention relates to a method for constructing a multi-walled large cylindrical storage tank, comprising vertical wall bodies made of plates welded together into a helix form, said plates being added at the lower body ends, successively as the body is moved upwards along the helix until the desired body height has been reached. The novel and characteristic features of the invention are that a plurality of wall or plate bodies are constructed inside one another, starting with the outermost and that an opening is left near the lower end of each finished body, through which opening the plates are inserted into the body under construction immediately inside the last finished body in the form of a tongue comprising at least one plate welded at one end to the plate course under construction, said plate tongue, by displacement of the body along the helix, is pulled in through the opening and is successively welded at its upper edge to the lower edge of the plates in the immediately preceding plate course.

5 Claims, 4 Drawing Figures

METHOD OF ERECTING LARGE CYLINDRICAL STORAGE TANKS WITH A PLURALITY OF VERTICAL PLATE BODIES ARRANGED INSIDE ONE ANOTHER

The present invention relates to the erection of multi-walled large cylindrical storage tanks comprising vertical cylindrical walls formed by plates welded together in a continuous row of plates forming a hollow cylindrical body, the said plates being added at the lower end of the body successively as the body is moved upwards along the line of a helix until the desired body height has been obtained. More specifically, the invention relates to such storage tanks with a plurality of plate bodies arranged inside one another, so-called multi-walled storage tanks, and in particular to storage tanks for storing gasses at very low temperatures. For such storage tanks, the invention provides quite considerable advantages over the prior art in this field.

The need for increasing amounts of industrial gasses resulted in the development of methods and equipment for converting gasses to liquid and for their storage in liquid form at low temperature in relatively large volumes. For the storage of ammonia, for example, single shell steel tanks were made in the form of vertical cylindrical vessels with flat bottoms. The required temperature insulation was attached to and supported by the tank wall. Increased thicknesses of insulation subsequently became necessary for the storage of liquid natural gas and was conveniently provided by loose Perlite® insulation. This led to the early doublewalled steel tanks. These tanks had an inner, also called primary, vessel of cryogenic metal, and an outer vessel composed of thin steel plate intended to provide only the retention of the loose insulation material and a vapour barrier to prevent both the escape of gasses contained between the vessels and the penetration of water vapour into this gas space from the ambient atmosphere. Such penetrating moisture, or water trapped within the tank during its construction, will migrate to the colder surface, i.e. the inner wall outer surface, and there form ice which can disrupt the proper functioning of the insulation and of parts of the tank which must remain free to move during operation of the tank. The inner vessel being elastic extends and contracts diametrically with the hydrostatic loading of the liquid contents during filling and emptying the vessel. The vessels parts also expand and contract with changes in temperature, in cooling down to be put into service and in warming up to be removed from service. A constant temperature at all relevant parts is impossible to achieve, and various elements have different coefficients of expansion, requiring often that differential temperature movements be accommodated. These arrangements can be disrupted by the formation of ice.

Cryogenic concrete walls have also been developed for the cold storage of liquids. Originally unlined prestressed concrete walls and domed roofs were used successfully to contain liquid oxygen. Later prestressed concrete walls with metallic liners to make them completely gas-tight were successfully built. Such lined prestressed concrete walls were applied both to the inner vessel and to the outer wall of double-walled l.n.g. storage tanks. The prestressed outer concrete wall increases the operational safety of the storage. Although in normal service they only retain the loose insulation material and provide a gas barrier, should the inner container fail to contain the liquid and flood the outer wall, the latter is expected to contain the liquid and prevent a catastrophe.

This conception of double-walled safety has also been applied to storage tanks in which there is in effect a primary cryogenic metal, container built within a similar container, both vessels being placed within the insulated space. Outside of the insulation either a metal-lined concrete wall providing third-wall safety, or a thin steel wall providing no further safety but simply insulation retention and the gas barrier may be built. The development of the roof configurations has been largely indepedent of the wall configurations of these storage tanks. Early tanks had cryogenic structural roofs operating in the cold gas space above the liquid surface and below the roof insulation. These were either self-supporting, or column-supported, metal roofs or cryogenic prestressed concrete domes. The roof insulation was laid above these roofs and the gas barrier in the form of continuously welded steel plates laid above the insulation. Subsequently the structural roof is usually made of mild steel and placed above the insulation which is suspended from the roof structure as an insulating ceiling to the inner container. The roof structure supports the gas barrier plates directly.

A modern storage tank for refrigerated liquids has the following configuration:

1. The primary container in contact with the liquid consists usually of a floor and wall of welded cryogenic metal, most often a nickel-steel alloy. The wall of this vessel is sometimes stiffenned against the external pressure exerted by the loose insulation.

2. The outer vessel consists of a metal floor, sometimes of cryogenic metal, attached at its perimeter to the liner of a metal lined prestressed concrete wall. It is separated from the primary container by layers of firm insulation at the floor, and by loose insulation in the space between the walls. In some tanks part of the insulation is applied in the form of insulation attached to an inner liner of the outer wall, or to the outer face of the inner wall.

3. A domed steel roof structure resting on the outer concrete wall which supports the roof gas barrier and an insulating ceiling which is hung below the structure. Additional weight and strength may be added to the roof in the form of prestressed concrete above the roof gas barrier, whereby higher operating gas pressures are obtainable.

4. Where additional safety is desired a further vessel similar to the primary container may be placed within the first primary container, or the floor only of such a container may be added under the floor of the primary vessel.

The bases and floors of these tanks are similar one to another. They consist of a concrete base plate either raised clear of the ground by piles or warmed by heating coils placed underneath or within the concrete base to prevent cold from travelling into the soil below the tank. On this concrete base a metallic vapour barrier forming the floor of the outer container is welded and anchored in place. Above this, layers of insulation material, usually load-bearing firm insulation capable of bearing the loading from the liquid and the weight of the inner wall are laid. The metallic floor of the inner vessel is laid over the insulation. If a further metallic floor is provided, it is separated from the primary floor by either a layer of insulation or by a protective layer of concrete or sand.

The outer concrete walls are cast in structural continuity with the floor slab. The wall's metallic liner, or alternatively the metallic outer wall itself, is welded to the floor liner, often with some means of accommodating differential movement of the wall or wall liner and the floor liner. The inner walls are held down, anchored to the concrete base by a variety of means, but are always left free to move radially as may be required by the hydrostatic load of the contents, or by changes in temperature. It is very important that the arrangements designed to accommodate movement of parts do in fact perform as envisaged by the designer, and not disrupted by unforeseen circumstances which may occur unperceived, as the safety of the tank in operation may be considerably reduced thereby.

The known methods of erecting the parts of the tanks above the floor level are essentially the following:

One method is to erect the first two or three tiers of the two-meter high shell plates of the inner wall, then erect a similar number of tiers of plates of the outer wall or wall liner, and then erect the part of the roof that can fit loosely within the inner vessels wall, together with most of the suspended ceiling. The shells are then raised stepwise by adding tiers of plates, tier by tier, above the plates already erected and welded. As each tier is welded the roof is raised up to the latest tier. The process is repeated until the shells reach their full height. This method has the disadvantage that the plates must of necessity be erected and welded in their final position, at increasing height above the ground, by workmen placed at these heights, working from scaffolds and exposed to the weather. The annulus between the walls is open to penetration of rainwater. The area within the inner wall is similarly penetrated by water as it runs off the roof and down the inner face of the inner wall. Rainwater cannot be allowed to penetrate into inaccessible places such as within the floor insulation layers, or underneath the floor plates, where it will cause corrosion. Further, when the tank is cooled down and put into service, the trapped moisture will migrate to the colder surfaces and be deposited as ice near the base of the inner wall, where it can disrupt the sensitive expansion arrangement and the insulation. The floor layers should therefore not be laid until the walls and roof of the tank have been completed and rainwater removed from within the tank, a requirement which extends the time of completion of the tank. The time to construct is invariably of the essence of the contract in the construction of these tanks.

A variation of this method is to build the walls and roof not simultaneously as indicated above, but in sequence, but this of course delays the completion even more.

Another method is to build the concrete walls with precast panels lined with metal. This method requires that the inner wall, made either of metal or of prestressed lined concrete panels as well, must be completed before the outer wall can be started. After the precast lined panels are erected the liner must be joined into an unbroken gas barrier by welding cover plates over the joints at each panel. These joints run the full height of the wall at each panel. The roof erection has to be delayed until there is an outer wall to receive the roof. The site is thus open to the penetration of rain water in a manner similar to that of the previously described method, with similar risks.

Another known method is to cast the outer concrete wall without a liner, using double-sided shuttering, leaving anchor bars cast in the concrete surface to which the liner can subsequently be welded after the wall is completed. The roof can by this method be erected as soon as the outer concrete wall is finished, enabling the remainder of the work to be done in a protected space. This method requires that the liner plate be attached to the wall by welding to the anchor bars left on the concrete surface. Since the plates are not in intimate contact with the concrete surface that they cover, they do not receive the protection from the concrete which for example naked reinforcement bars receive, and must therefore be protected from corrosion by protecting the surface of the plate. The protection must be applied before the liner plates are installed, and this protection is damaged by the subsequent welding. Moisture penetrates into the space between the concrete and steel plates and causes corrosion. A further problem is the necessity to stockpile materials within the tank to construct the inner wall. The stockpiling of material together with the need to move cranes within the tank to erect the inner wall plate by plate in their final location, slows the speed of erection of the inner wall. The floor layers cannot be laid until the stockpiles and movement of cranes cease.

The quality of the welding in these storage tanks is of utmost importance and concern, due to the potential catastrophic results which can result of a failure. Control of welding processes is very strict and meticulous. Not only are the completed welds subjected to X-ray inspection, but there is intensive and repeated welding control at every stage of the joint, from the time that the joints are presented, up to their completion at every intermediate stage. There is control of plate temperatures and inspection for cracks and weld defects at the intermediate stages of cleaning the partially completed welds prior to further welding by dye-penetrant methods. In all the abovementioned methods the welds are performed at their final location, often inadequately protected from the weather with removeable tarpaulins, with varying wind conditions and varying weld temperatures and cooling rates. Furthermore, the inspection of these welds requires the movement of supervisory personnel and their equipment along scaffolds at not inconsiderable heights above the ground. This reduces the quality of the inspection, as well as that of the welds, and increases the delays caused by the inspection. often unperceived, due to the problems of producing good welds under temporary covers in situ.

The present invention seeks to remove or at least substantially reduce the dangers of corrosion in the gas-tight steel lining of the concrete outer shell in the tanks mentioned here, both with regard to the safety of the tank and to the life of the lining, which cannot be replaced. It seeks to reduce the possibility of trapping moisture within the tank, often unperceived, that can subsequently be deposited as ice at the inner tank wall base perimeter and prevent the correct functioning of expansion joints, tank anchorage, and insulation as envisaged by the designer. It seeks to reduce the construction costs without compromising the quality and integrity of the construction. This invention also seeks to simplify and facilitate the work and improve the quality of the welds and of their inspection. These advantages are now available to all configurations of large cylindrical plate storage tanks with several walls.

In order to fulfill these purposes and starting from the method, which is known per se, of erecting cylindrical storage tanks comprising vertical wall bodies made of plates welded together into a helix form, said plates being added at the lower body ends, successively as the body is moved upwards along the helix until the desired body height has been reached, a new and improved method is suggested according to the invention of erecting multi-walled large cylindrical tanks with a plurality of wall or plate bodies arranged inside one another.

The primary characteristics of the new method according to the invention are that a plurality of wall or plate bodies are constructed inside one another, starting with the outermost, and that an opening is left near the lower end of each finished body, through which opening the plates are inserted into the body under construction immediately inside the last finished body in the form of a tongue comprising at least one plate welded at one end to the plate course under construction, said plate tongue, by displacement of the body along the helix, is pulled in through the opening and is successively welded at its upper edge to the lower edge of the plates in the immediately preceding plate course.

A number of significant advantages are achieved by using the method according to the invention and beginning by erecting the outermost wall. In the first place, all of the advantages of the known and tested method of erecting large cylindrical tanks with vertical walls with plates welded together in a helical shape can be fully used. Secondly, the major part of the work of erecting the inner wall inside a previously erected plate wall to which a plated roof is welded takes place protected thereby and thus in an almost indoor environment. This is of much importance, as much at work sites with climatic extremes, such as hot and dusty desert areas or arctic areas, as in temperate climates with wind and rain to contend with.

The invention appears, however, to have its most important technical and economic advantages in connection with the erection of multi-walled storage tanks which have a prestressed concrete outer wall provided with a gas-tight liner in the form of a thin welded steel shell to seal the concrete. Application of the construction method according to the invention to such a tank construction will, in addition to the above mentioned advantages, also practically completely eliminate the corrosion problems which have been discussed previously.

Since the comparatively thin welded steel shell serving as a gas-tight lining to the concrete outer wall in these storage tank constructions can be erected, because of the invention, prior to the inner plate walls, and also prior to the concreting of the outer wall, it can be erected with all its required stiffeners, and together with the complete roof, in relatively short time, and after being welded together, it is easily accessible everywhere for anti-corrosion treatment. As part of the erection process, the liner is suitably provided with all the anchoring required for attaching the plate to the concrete outer wall. In the method according to the invention, they can be allowed to project from the liner with free outer ends which will be automatically cast in the concrete applied subsequently the liner serving as built-in permanent shuttering, thus becoming intimately joined with the concrete and ensuring that no corrosion problem can arise with this liner.

In addition to avoiding the corrosion problems which might arise in such multi-walled storage tanks, the invention also simplifies the construction of the concrete wall not only by providing a readymade shutter at one side of the wall, but it also provides a firm surface from which to line up the sliding shutter at the other face, provides the means to retain the shutter in place during concreting, and the means to support and to raise the shutter from the top of the completed liner wall. There is also the significant advantage that the reinforcement for the concrete wall, and the prestressing means, can be attached to the steel plate liner, long before the casting of the wall concrete by the sliding shutter method is begun. The operations of attaching the concrete reinforcement and prestressing means are also carried out at fixed work stations at or near ground level, where they can be performed safely and easily inspected, as the shell is rotated past the work station, and not as is usual, under the pressure of uninterrupted casting of concrete by sliding shutters, which must be kept moving up. This furthermore increases the efficiency of the subsequent casting of the wall concrete which can now progress unimpeded by these operations of adding reinforcement and prestressing means, that have been completed and inspected well in advance.

The invention enables the use of the helical method of erection of vertical shells to be employed in the inner walls. The operations in this method are restricted to a narrow area at the perimeter of the wall under erection, leaving the remainder of the floor enclosed by the shell under erection free for other construction operations, which can now progress undisturbed by the movement of cranes, or the stockpiling of shell plates, or the risk of parts which are being erected at a height falling on workmen below. The layers of insulation at the floor and the laying and welding of the plates forming the floors, can now therefore be carried out simultaneously with the work of erecting the inner shells, which work furthermore is carried out entirely in the dry and protected inner space of the tank.

Furthermore, the method according to the invention provides a significant improvement in the quality of the structure, due to the improved, more systematic, more comfortable and safer, as well as more precise execution of the presentation, the welding and the inspection of the welded joints. The same welding operation is performed at each work station, and checked at each inspection station, as the shell is rotated past these stations, whereby every joint receives systematic attention under precisely similar conditions of welding.

Finally, the significant advantage is obtained that it is now possible by applying this method to introduce assembly-line-construction of storage tanks, which is more rational than the construction methods used hitherto, and which can be applied now also to the inner walls.

An example of the invention will be described below in more detail with reference to the accompanying drawings.

Figure 1:
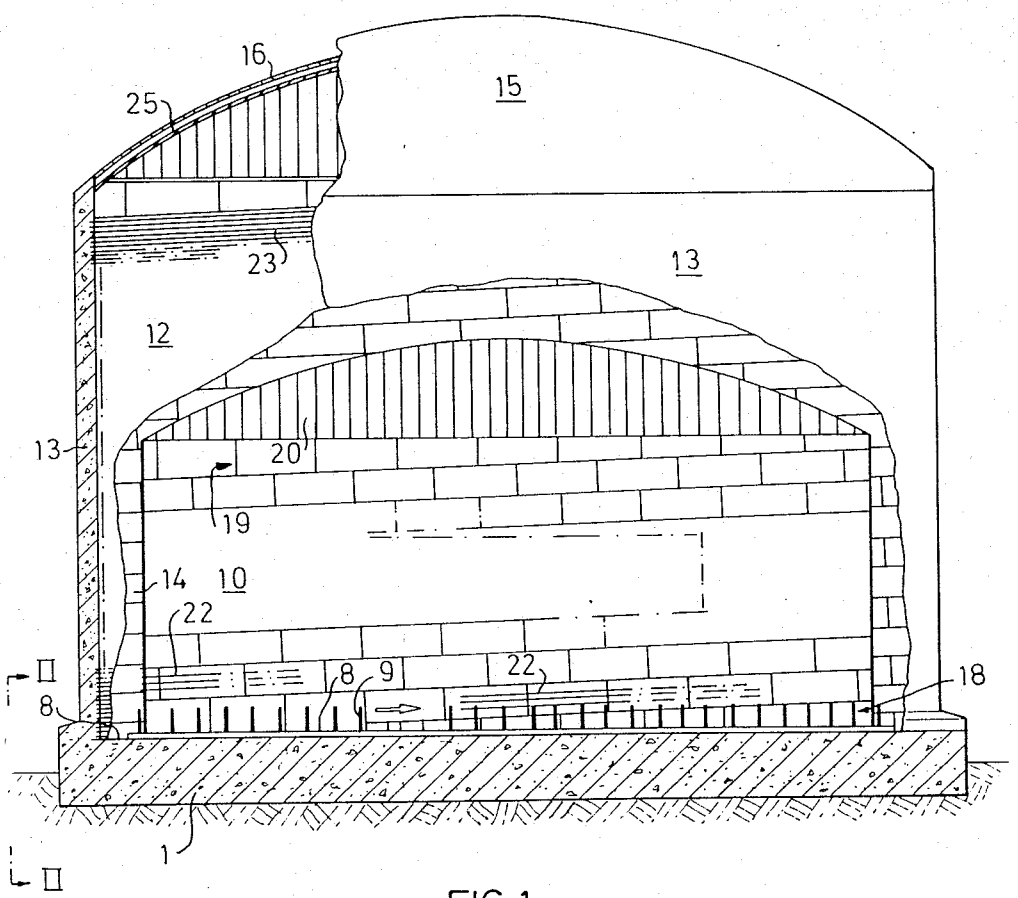
FIG. 1 shows in schematic form a partially cut-away side view of a multi-walled vertical cylindrical storage tank, erected by means of the method of the invention and designed to store liquid gas at very low temperature.
Figure 2:
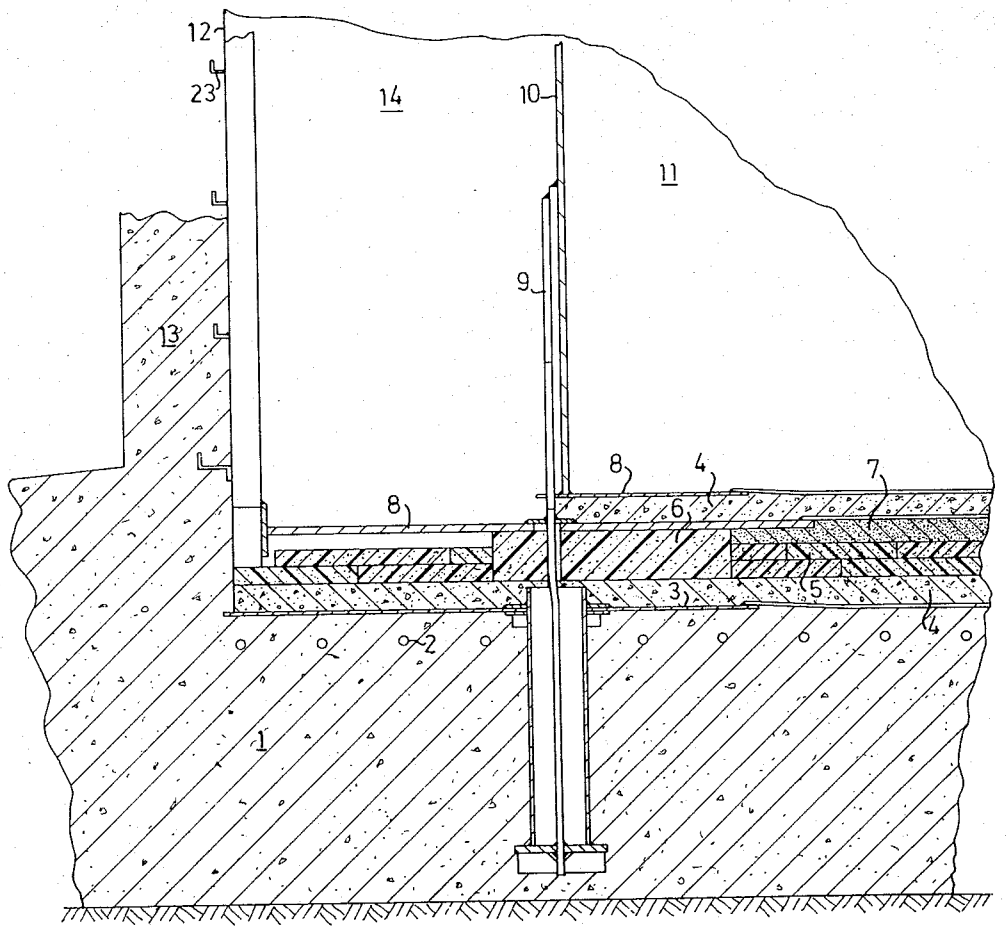
FIG. 2 is an enlarged vertical section along the line II—II in FIG. 1 through portions of the walls of the storage tank.
Figure 3:
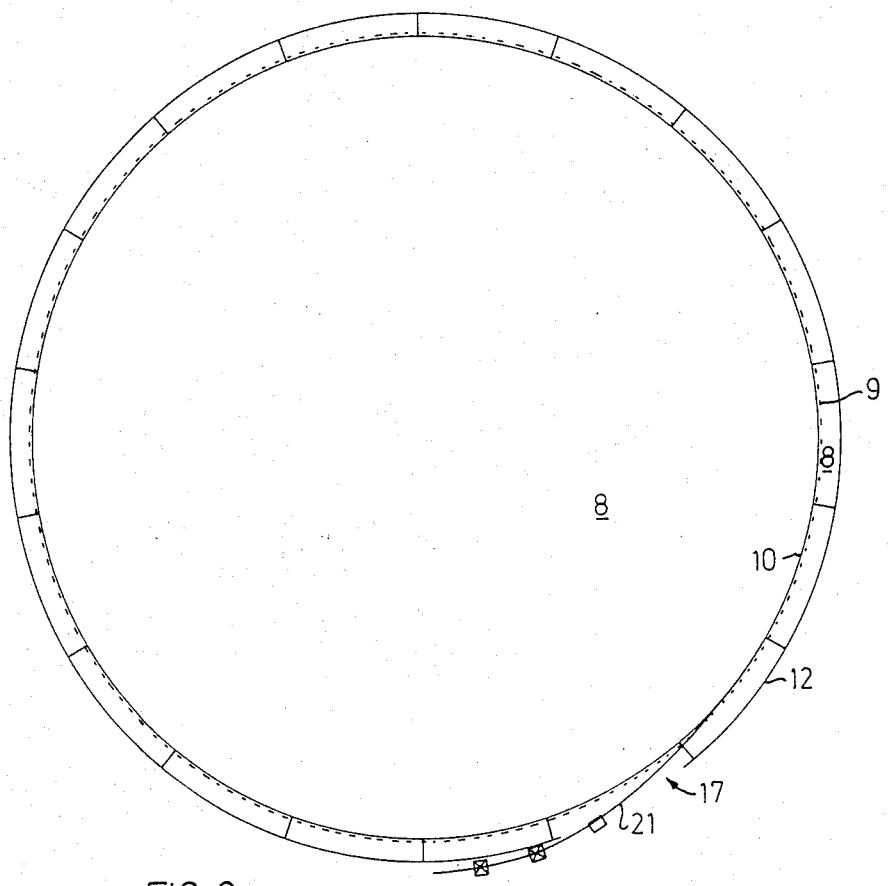
FIG. 3 is a schematic plan section through two of the walls which consist of concentric walls made of plates welded together along a helical line. The outer wall is finished and the inner wall is under construction.
Figure 4:
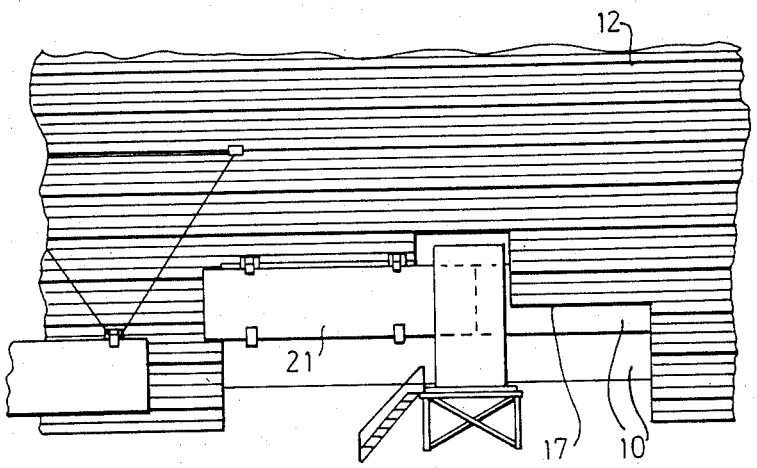
FIG. 4 shows a detailed view of the finished outer wall shown in FIG. 3, provided with an opening through which plates are inserted for the inner wall still under construction in accordance with the method of the invention.

FIGS. 1 and 2 show that the multi-walled vertical cylindrical storage tank for liquid gas at very low temperature is erected on a concrete floor 1. A portion of the floor beneath the interior of the finished storage tank is, as can best be seen in FIG. 2, provided, as is usual in such storage tanks, with a heating system 2, and a vapour barrier 3, and has on top of it in successive layers concrete 4, glass-wool 5, Perlite® blocks 6, sand-bitumen mix 7, and a double inner floor 8, separated by a further layer of concrete 4. Furthermore there are a large number of anchors 9 projecting above the floor liner 8, for anchoring the inner wall 10 of the storage tank to the concrete floor 1, and are therefore cast in the floor and are evenly distributed about the outer periphery of the said wall.

The inner vertical cylindrical wall 10, which consists of steel plates, encloses the liquid storage space 11 inside the storage tank and is in turn enclosed by a concentric outer, vertical cylindrical wall 12, which is also made of steel plate, and constitutes an interior gas-tight lining for the actual outer wall 13 which consists of horizontally and vertically prestressed concrete.

In the annular space 14 between the outer 12 and the inner 10 concentric walls, Perlite® can be suitably placed as a temperature insulator, thus providing the thermos bottle effect in the storage tank, which is desired in such gas storage structures.

The construction described here is that of a storage tank which provides so-called outer-wall safety, i.e. the outer concrete wall 13 is capable of withstanding the pressure exerted by liquid gas flowing out of the intended storage space 11 if the inner wall 10 were damaged. Said gas is also prevented from penetrating the outer concrete wall 13 by means of the gas-tight lining 12 of the wall.

On top of the concrete outer wall with its gas-tight lining 12, a steel domed structure 25 supports a welded steel plate gas barrier 16, above which a prestressed concrete roof 15 is built.

Since the multi-walled storage tank shown is made by the method according to the present invention, the two plate walls in the storage tank, i.e. the outer wall 12 serving as a gas-tight liner for the concrete outer wall 13, and the inner wall 10 serving as the wall of the primary container, are each made of plates of suitable dimensions and quality, welded together to form a helical row of plates forming the vertical cylindrical wall. The plates are successively attached at the lower end of the helical row of plates as the wall is displaced along the helix until the desired wall height is reached.

After casting the concrete floor 1 out as far as the perimeter of the floor vapour barrier 3, the outer annulus of the floor vapor barrier 3 was laid and welded. The uppermost plate course and the lowermost plate course of the outer wall (corresponding to parts 19 and 18 in the case of the inner wall) were first erected, forming a low cylindrical wall, upon which the dome roof steel structure 25 and the roof vapor barrier 16 were erected and welded, thus providing complete weather protection to the inside of the low wall. The outer wall liner 12, suitably reinforced by helical reinforcing rings 23 was then erected and welded by the helical method of erection. The operations of adding a plate to the shell, welding it, adding helical rings 23 and welding them, inspecting and testing the welds, inspecting and repairing the previously applied shop-coated anti-corrosion protection of the plates and rings and applying protection to the welds, the attachment of the wall concrete reinforcement bars, cable prestressing ducts and sundry other attachments to be used later in the concreting of the outer wall 13 were repeatedly performed at fixed work stations deployed around the perimeter of the outer wall 13, protected by semi-permanent weatherproof covers outside and by the roof 16 at the inside of the outer wall liner 12, as the shell was rotated past these work stations. All the parts thus attached, inspected and approved, were carried by the liner wall 12, as well as the roof structure and roof gas barrier 16, as it was moved along the helix, gradually rising higher and higher as the shell increased in height. When all the shell plates had thus been erected and the wall 12 had reached its full height, an opening 17 was left in the liner wall 12 to enable the erection of the inner wall 10.

While these operations of erecting the liner wall 12 were taking place at the work stations deployed at the perimeter, the remainder of the floor plates to the whole floor liner 3 which had been stockpiled within the tank were laid and welded. On completion of the erection of the liner 12, the lower concrete layer 4, the insulation layers 5 and 6, the bitumen-sand mix layer 7, the lower inner floor liner 8, the upper concrete layer 4 and the outer annulus of the upper inner floor 8 were laid and welded, while the remainder of the plates 8 to complete the floor entirely were stockpiled inside the tank. The erection of the inner wall 10 and inner roof 20 was commenced.

As previously in the erection of the outer wall liner 12, the lowermost plate course 18 in the inner wall 10 was first constructed on the outer annulus of the inner floor 8. On the upper edge of the said lowermost plate course 18, a number of lifting and displacing means, for example of the type described in Swedish Pat. No. 7903236-2, were mounted, evenly distributed about the uppermost entire perimeter. The plate course 19 and the roof 20 were then constructed separate from but rotatably supported on the lowermost plate course 18 by means of the said lifting and displacing means (not shown), which move the upper wall portion along the helix of the upper edge of the lowermost plate course 18, in a manner which is both well-centered and well-regulated with regard to the rate of displacement.

The remainder of the plates that are required for the inner wall 10, and which are located between the two individually constructed lower 18 and upper 19 courses, are constructed by adding plates to the wall in the form of a tongue 21 consisting of at least one plate welded at one end to the previous plate already incorporated into the upper portion 19, said plate tongue 21, by displacement of the upper portion of the wall 10 along the helix, is pulled in through the opening 17 and is successively welded at its upper edge to the lower edge of the plate in the immediately preceding plate course above. Plates taken from stockpiles outside the tank are added to the tongue 21. The movement of the upper portion of the shell and roof along the helix continues until all the plates composing the inner wall 10 have been thus inserted and incorporated into the wall, and the inner wall 10 is at its required finished height. The lifting and displacing equipment is now removed and the joint along the helix between the upper portion of the wall 10 and the fixed lowermost plate course 18 is welded.

While these operations of building the inner wall 10 were in progress, the work of laying and welding the remainder of the inner floor 8 has been completed.

If temperature insulation is to be attached to the inner wall 10, or if the wall is to be strengthened by stiffening rings against external insulation pressure, the insulation supports or the stiffening rings in the form of suitably formed profiles 22 can be successively attached to the tongue 21 and installed in a helical pattern matching the plate helix.

On completion of the inner wall 10, all steel erection for the construction of the whole tank has been completed. The opening 17 in the outer wall liner 12 is now closed. The wall 13 is now concreted with sliding shutters supported from the liner 12 and subsequently the roof 15 is concreted. The wall and roof is now prestressed, and finally the space between the inner and outer vessels are insulated. Throughout the construction, either steel erection and welding only, or concreting only without the presence of steel erectors and welders has been achieved. Thereby disruption to either the so-called civil works or the so-called mechanical works by the other are avoided, without extending the time of completion.

By virtue of the fact that the major portion of the welding work in connection with the erection of the two plate walls 10,12 can take place at or near ground level, at fixed work stations, each performing repeated operations in an assembly-line fashion, the method according to the invention is more efficient than previously used construction methods. At the same time, the risk of personal injury in the erection and welding work is reduced, a better quality of the production, of the control and of the inspection of the welded joints is ensured, thus improving the quality of the structure as a whole, as well as reducing its cost.

Anticorrosion treatment of the outer wall liner and of the attached profiles is simple and certain. The material arrives on the site with a factory applied protective coating, invariably of better quality than can be applied in situ. The operations of inspection for damage, making good as well as applying coating to the welded joint areas are operations added to the assembly-line, at protected work stations. The profiles 23 are subsequently embedded in the concrete cast between the liner and the sliding shutter, the risk of subsequent corrosion thus being avoided and the long life of the liner plate ensured.

Since the work of erecting both walls 12,10 is done by operations restricted to the immediate perimeter of the walls, work can progress on the floors in the protected and dry environment within the tank at the same time as the shells are under erection, without disrupting the work of the erection of the shell, and without endangering the correct functioning of the expansion arrangements, anchoring devices and insulation by the penetration of water within the tank during its construction. This gives further a reduction in the time of construction.

The invention is however not limited to the example described herein and shown on the drawings. It can be modified and adapted in many different ways, especially with regard to the particular configuration of the tank to be constructed and to the site conditions, within the scope of the patent claims.

I claim:

1. Method for constructing a multi-walled large cylindrical storage tank comprising vertical wall bodies made of plates welded together into a helix form, comprising successively adding said plates at the lower body ends while moving the body upwards along the helix until the desired body height has been reached, the improvement comprising constructing a plurality of wall or plate bodies inside one another, starting with the outermost, leaving an opening near the lower end of each finished body, inserting the plates through the opening into the body under construction immediately inside the last finished body in the form of a tongue provided by welding at least one plate at one end to the plate course under construction, by displacement of the body along the helix pulling said plate tongue in through the opening and successively welding the upper edge of the tongue to the lower edge of the plates in the immediately preceding plate course.

2. Method according to claim 1, further including constructing on and welding the lowermost plate course in each body to a prefabricated bottom for the respective body, the uppermost plate course and the roof of the body in question being fabricated and carried above the lowermost course and rotatably separated therefrom, and the rest of the required courses in the body being made by adding successively, next to the lowermost plate course, plates to the lower end of the rotatably carried body portion as it is displaced upwards along the helix, until the required body height has been reached, at which time the lower edge of the body portion produced during the helical displacement is welded to the lowermost plate course projecting up from the bottom.

3. Method according to claim 1 or 2, further including successively attaching the necessary reinforcing means to the lower part of the body portion being displaced helically.

4. Method according to claim 1 or 2, further including successively attaching mounting means for the insulation and mounting said insulation on said mounting means at the lower part of the body portion being displaced helically.

5. Method according to claim 1 or 2, further including successively mounting anchoring members for subsequent casting in concrete at the lower part of the body portion being displaced helically.

* * * * *